United States Patent [19]

Johnston

[11] Patent Number: 4,787,183

[45] Date of Patent: Nov. 29, 1988

[54] TRUSS ARRANGEMENT

[75] Inventor: Ronald J. Johnston, Georgetown, Canada

[73] Assignee: Aluma Systems Ltd., Downsview, Canada

[21] Appl. No.: 813,242

[22] Filed: Dec. 24, 1985

[51] Int. Cl.[4] ..... E04G 11/36

[52] U.S. Cl. ..... 52/126.4; 52/126.5; 52/646; 249/28

[58] Field of Search ..... 52/126.5, 126.7, 637, 52/693, 650, 731, 732, 646, 641, 126.4, 126.6; 182/178, 179; 249/18, 24, 28, 27, 29, 210

[56] References Cited

U.S. PATENT DOCUMENTS

| | | | |
|---|---|---|---|
| 1,360,131 | 11/1920 | Miller . | |
| 1,706,801 | 3/1929 | Merrill . | |
| 1,791,827 | 2/1931 | Milburn . | |
| 2,101,317 | 12/1937 | Lemieux . | |
| 2,201,608 | 5/1940 | Causey . | |
| 2,294,240 | 8/1942 | Pollman . | |
| 2,468,186 | 4/1949 | Du Perret . | |
| 2,804,673 | 8/1957 | Fex . | |
| 2,846,085 | 8/1958 | Johnson . | |
| 2,849,258 | 8/1958 | Crook . | |
| 2,957,543 | 10/1960 | Larson . | |
| 2,990,203 | 6/1961 | Grover et al. . | |
| 3,163,911 | 1/1965 | Kenney . | |
| 3,190,405 | 6/1965 | Squire . | |
| 3,246,871 | 4/1966 | Bowden . | |
| 3,564,783 | 2/1971 | Dunne . | |
| 3,650,081 | 3/1972 | McCraken | 52/637 |
| 3,684,058 | 8/1972 | Brown . | |
| 3,685,665 | 8/1972 | Atwater . | |
| 3,782,048 | 1/1974 | Corman . | |
| 3,787,020 | 1/1974 | Avery . | |
| 3,826,057 | 7/1974 | Franklin | 52/641 |
| 3,899,155 | 8/1975 | Ward . | |
| 3,966,164 | 6/1976 | Dashew . | |

(List continued on next page.)

FOREIGN PATENT DOCUMENTS

| | | |
|---|---|---|
| 132027 | 4/1949 | Australia . |
| 205507 | 11/1956 | Australia . |

(List continued on next page.)

OTHER PUBLICATIONS

Interform L. W. Brochure, Patent Scaffolding Co., 1981.

(List continued on next page.)

*Primary Examiner*—J. Karl Bell

*Attorney, Agent, or Firm*—Arnold, White & Durkee

[57] ABSTRACT

The present invention discloses a new concrete forming system and components therefor, particularly adapted for forming of vaulted ceilings and for use in buildings wherein the floors at the edges thereof have upwardly extending sills and/or wherein the ceilings have been dropped by a similar ledge or sill thereby significantly reducing the clear area through which a truss can be removed. The truss comprises a top chord and a bottom chord interconnected by upright members and diagonal bracing members. A number of adjustable extension legs are associated with the upright members and are telescopically received within an upright member such that a leg extending to the upper side of the truss can overlap with a leg extending to the lower side of the truss, whereby the legs extending above the truss can be adjusted and maintained independent of the legs extending below the truss. In contrast to the prior art practice of having the upper chord of the truss at the lowest level of the ceiling with "packing" thereabove to define and support the concrete forming surface. The present system provides load collecting support beams adjustably secured above the upper chord of the truss by extendable legs whereby the position of the support beam can vary relative to the top chord of the truss. The height of the truss is used to accommodate the extendable legs which position the truss above the floor as well as the extendable legs supporting the load collecting beam, whereby the amount of packing and the time required to initially set up the system for a given building are reduced. Therefore, the present invention relates to improvements in flying forms and components thereof and in particular to a system which is more flexible and adjustable for the forming of vaulted ceilings.

21 Claims, 6 Drawing Sheets

U.S. PATENT DOCUMENTS

| | | | |
|---|---|---|---|
| 4,036,466 | 7/1977 | Van Meter . | |
| 4,102,096 | 7/1978 | Cody | 52/126.7 |
| 4,106,256 | 8/1978 | Cody . | |
| 4,136,785 | 1/1979 | McDevitt . | |
| 4,144,690 | 3/1979 | Avery . | |
| 4,156,999 | 6/1979 | Avery . | |
| 4,216,933 | 8/1980 | Cramer . | |
| 4,227,672 | 10/1980 | Cunningham | 249/28 |
| 4,291,784 | 9/1981 | Moses . | |
| 4,462,197 | 7/1984 | D'Alessio et al. . | |
| 4,492,358 | 1/1985 | Manderla | 249/28 X |
| 4,514,940 | 5/1985 | Manderla | 52/637 |
| 4,585,204 | 4/1986 | Parker et al. | 52/646 X |
| 4,685,264 | 8/1987 | Landis | 249/28 X |
| 4,693,449 | 9/1987 | Cunningham | 249/28 X |

FOREIGN PATENT DOCUMENTS

| | | |
|---|---|---|
| 551811 | 1/1958 | Canada . |
| 957819 | 11/1974 | Canada . |
| 1204096 | 5/1986 | Canada . |
| 263317 | 7/1968 | Fed. Rep. of Germany . |
| 1901880 | 7/1969 | Fed. Rep. of Germany . |
| 2302561 | 7/1974 | Fed. Rep. of Germany . |
| 934577 | 5/1948 | France . |
| 1099331 | 9/1955 | France . |
| 1123790 | 9/1956 | France . |
| 1229330 | 9/1960 | France . |
| 2454011 | 6/1980 | France . |
| 340724 | 1/1931 | United Kingdom . |
| 943524 | 12/1963 | United Kingdom . |
| 1018706 | 2/1966 | United Kingdom . |
| 1142861 | 2/1969 | United Kingdom . |
| 1148633 | 4/1969 | United Kingdom . |
| 2041059 | 9/1980 | United Kingdom . |

OTHER PUBLICATIONS

Advertising Brochure, Hussor.

Hi-Load, The Complete Shoring System, Waco.

Zip Span Brochure, Anthes.

Interform 30 K. A. Brochure, Patent Scaffolding Co., 1982.

Interform 30 K. Brochure, Patent Scaffolding Co., 1981.

Interform Brochure, Patent Scaffolding Co., 1982.

Shore "X" Shoring System Brochure, Waco, 1971.

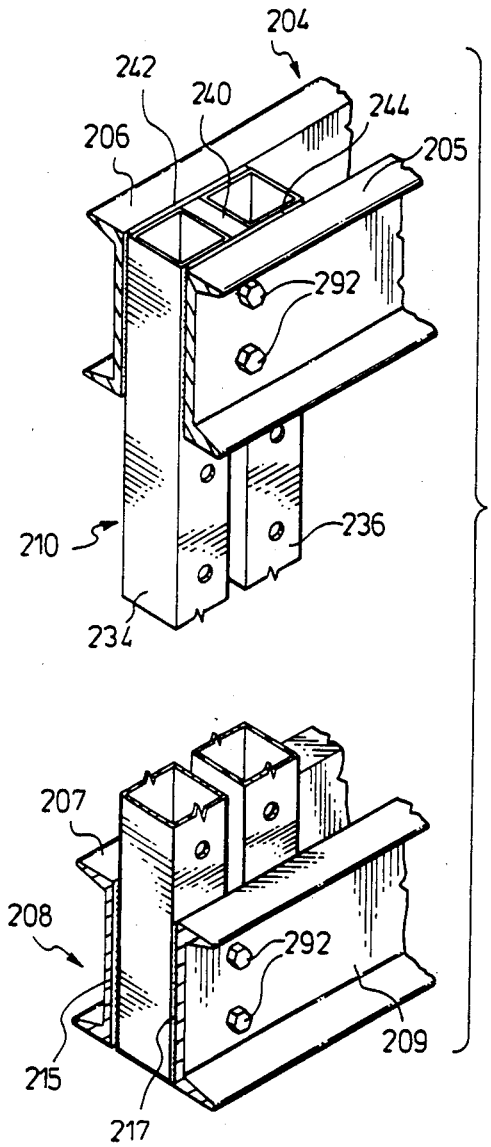
FIG. 7.
FIG. 8.
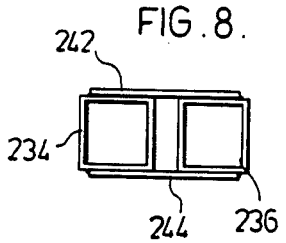
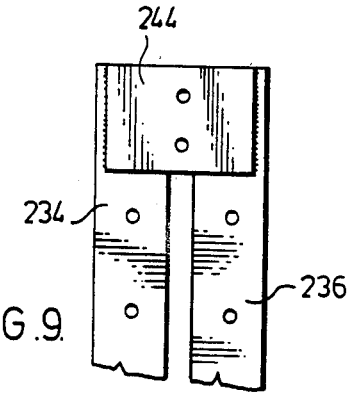
FIG. 9.

TRUSS ARRANGEMENT

BACKGROUND OF THE INVENTION

The present invention relates to forms and components thereof for use in concrete forming and in particular, forms and components thereof which include trusses for forming of concrete floors. The forms preferrably are of the type that are adapted to be lifted by crane between floors of a building during the construction thereof, thereby substantially reducing the time required to set up the form for pouring of the next floor. In particular, the invention is directed to forms which provide additional flexibility and convenient adjustment to define a system for forming of ceilings of different heights or vaulted ceilings.

Flying forms, which are essentially a number of interconnected truss structures adapted to be moved on rollers or the like beyond the building and lifted to the next floor, greatly reduce the required labour necessary for set-up of the forms. Forms of this type include U.S. Pat. Nos. 4,077,172, 3,966,164, 3,787,020 as but some examples. Recent architectural design to provide additional strength has used concrete ceilings provided with concrete beams which require a stepped ceiling. It is also common to provide a concrete sill at the edge of the floor and a downwardly extending edge portion from the ceiling to reduce the window size. Such structures present additional problems as "packing" is required on the top surface of the truss to accomodate the changing heights of the ceiling. This "packing" is commonly made of wood and beams and as such is very labour intensive and costly. The amount of "packing" can be quite substantial as the top chord of the truss can only be located below the lowest position of the ceiling. When the truss is collapsed for movement between floors, by the lower legs being retracted within the truss, the effective height of the truss is the extent to which the legs may extend below the truss, the height of the truss and the height of any "packing" material secured above the truss. Often this effective height is such that flying forms cannot be used due to the reduced clear area between the concrete sill and downwardly extending ceiling edge.

According to the present invention, a system is provided which uses an intermediate truss which has extendable legs associated therewith. Certain of the legs are associated with the truss to extend below the truss for engaging a support surface and other legs extend above the truss to engage a load collecting beams. Movement of the truss between floors is possible as the lower extension legs collapse or telescope within the truss. The truss is such that the legs each telescope within their own associated tube or recess of the truss whereby the length of the leg can be approximately equal to the height of the truss and, it can be extended further by use of a screw jack. The amount of "packing" and the labour associated therewith is reduced as the extendable legs above the truss are adjusted to accomodate the height of the ceiling and position load collecting beams. As each leg is independently movable within the truss, maximum height of the truss and legs is increased by about the height of the truss as legs extend top and bottom. An upright member for a truss according to an aspect of the invention comprises two paired members disposed in parallel relation and connected to each other by connecting means intermediate the said members. Each of the members includes generally planar opposed parallel bearing surfaces and each bearing surface on one member is colinear with a bearing surface on the other tube member.

BRIEF DESCRIPTION OF THE DRAWINGS

Preferred embodiments of the invention are shown in the drawings, wherein:

FIG. 7 is a partial cut-away perspective view of the truss system with a modified construction;

FIG. 8 is a top view of the modified upright; and

FIG. 9 is a partial sideview of the modified upright.

DETAILED DESCRIPTION OF THE PREFERRED EMBODIMENTS

Figure 1:
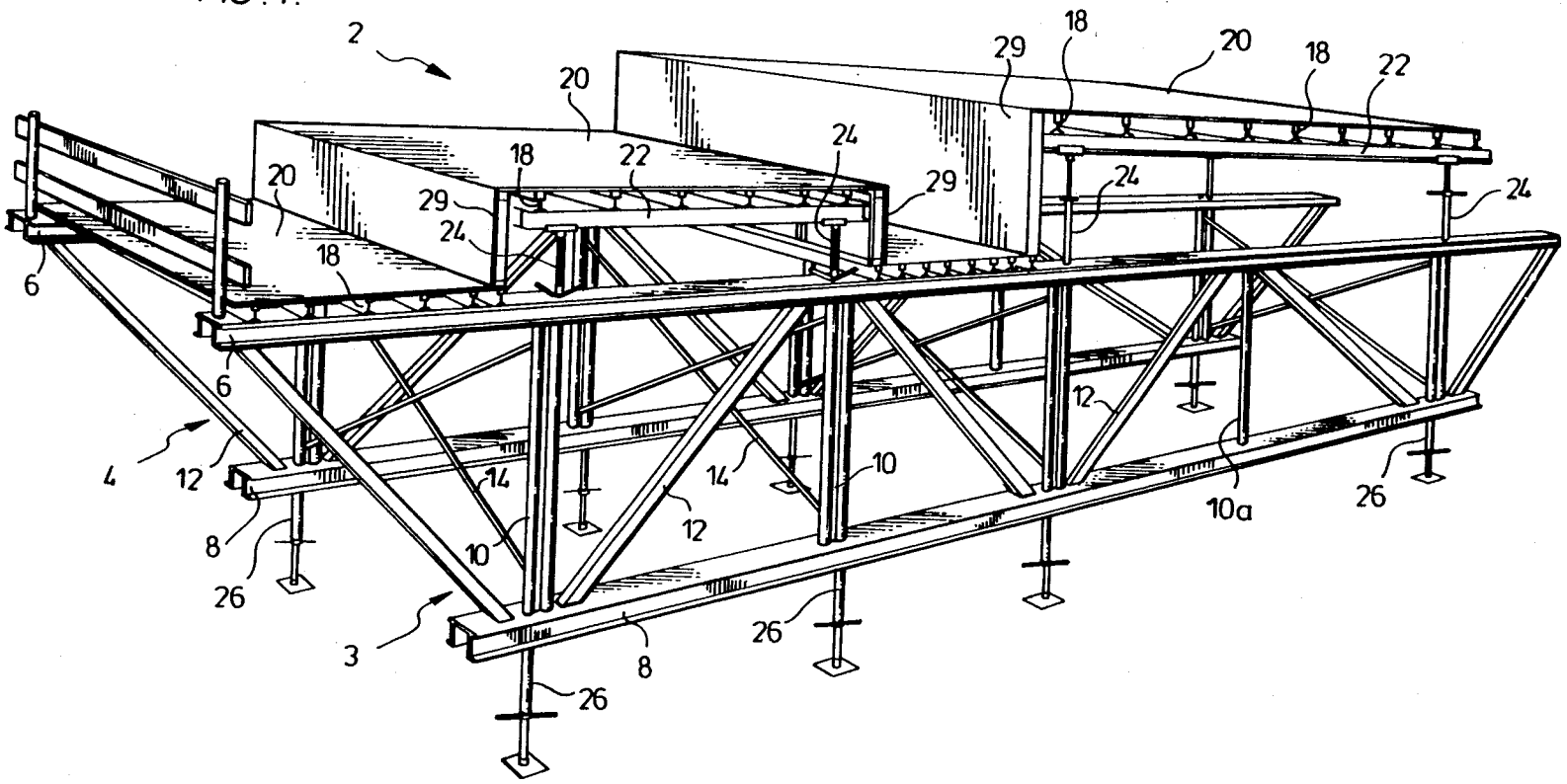
FIG. 1 is a partial perspective view of a truss used in concrete forming.

The concrete forming system generally shown as 2 in FIG. 1 has parallel trusses 3 and 4, each having a top chord member 6 and a bottom chord member 8, spaced by upright members 10 and truss diagonal braces 12. The trusses are interconnected by the braces 14. Load collecting beams 22 preferrably run parallel with the top chord 6 of each truss or perpendicular to the top chords 6. The sheeting material 20 is secured atop the beams 18 and at least partially defines the concrete form. A number of trusses 6 can be interconnected for forming larger areas and can be moved as a unit depending upon the construction site and the crane capacity. In the system shown in FIG. 1, 3 different concrete forming levels are shown for accomodating concrete beams and stepped areas formed as part of the floor. Load collecting beams 22 are appropriately positioned by extendable legs 24 or screw jacks as shown, of a size for receipt within an upright member 10. Extendable legs 26 are positioned adjacent the bottom edge of the truss, support the truss at the required height above a support floor. Therefore, the truss, defined between the top chord member 6 and the bottom chord member 8, is positionable at various spacings above a support floor by adjusting the lower extendable legs 26. Extendable legs 24 allow for fast positioning of load collecting beams 22, in accordance with the desired ceiling profile. The legs 24 and 26 are telescopically received within the upright members 10 without interference between leg 24 and 26. This occurs as the legs are adjacent to each other and each upright member 10 has the capacity for receiving two legs. This in effect allows the maximum height of the concrete forming system to be substantially increased relative to the spacing between the top chord 6 and the bottom chord 8 and results in a more efficient and flexible system as the amount of "packing" required has been reduced and the ability to easily define different concrete support levels has been improved. In the system as shown in FIG. 1, "packing" 29, illustrated as 2×4's nailed to the sheeting material 20, is provided at each change in level of the form. The packing for a given level has been replaced by load collecting beams 22 supported by legs 24. Normally it will not be necessary for all uprights 10 to receive extendable legs and some may merely act as a structural member such as upright 10*a*.

Figure 2:
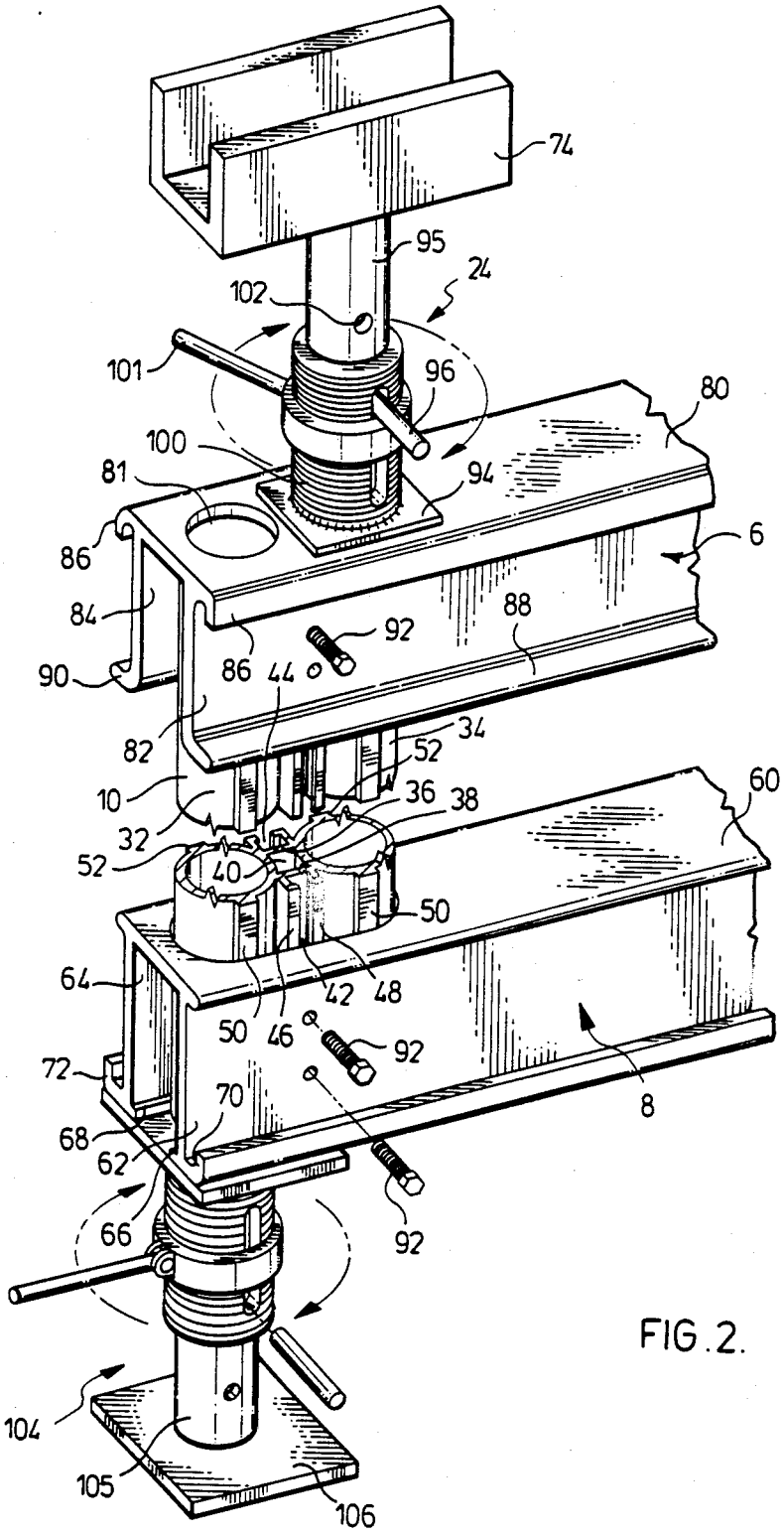
FIG. 2 is a partial perspective view of a portion of a truss illustrating the co-operation of the upright support members with the top and bottom chords of the truss.

Details of the telescopic receipt of extendable leg 24 and extendable leg 26 within one of the upright members 10 can be appreciated from FIG. 2, where upright member 10 has two opposed members 32 and 34, each of a size for receiving an extension leg. Webs 36 and 38 in combination with members 32 and 34, define a closed cavity 40. This cavity is advantageously used to receive bolts 92 for connecting the upright member 10 to the chord members 6 and 8. As the bolts pass through the cavity 40, the hollow portion within each of the tube members 32 and 34 remains clear and allows extendable legs 24 and 26 to collapse or telescope within the full length of each tube member. To the exterior of web members 36 and 38, bolt slots 42 and 44 are provided. Bolt slot 42 has exterior flanges 46 and 48 which define a planar face for engaging the interior surface of the side plate 62 of the bottom chord member 8 and the interior surfaces of the side plate 82 of the top chord member. Bolt slot 44 includes similar flanges and cooperates with side plates 64 and 84. In addition each tube member includes opposed thickened portions 50 and 52 having a planar outer face. The face of portions 50 are co-planar with flanges 48 and 46 which also engage the interior surface of the bottom chord member and the top chord member to provide a more secure fit of the upright member within the chord members. Portion 52 cooperates with the flanges of bolt slot 44 to engage the opposite side plates of the top and bottom chord. The bolts 92 pass through the side plates of the chord members and through the bolt slots to apply the pressure adjacent these planar engaging faces to increase the structural integrity of the system. The uprights are preferrably extruded of a magnesium or aluminum alloy although not limited thereto.

The top chord member 6 includes a top plate 80 which extends beyond the side plates 82 and 84 to define downwardly extending lips 86, either side of the longtitudal axis of the top chord member 6. These lips 86 are used for clamping of additional components to the top chord member. The top plate 80, includes a circular opening 81 to allow access to the hollow interior portions of the tube members 32 and 34 whereby the extendable leg 24 can be received in either of the tube members 32 and 34.

The bottom chord member 8, is open on the bottom and as such the hollow interior portions of tube members 34 and 36 are exposed at the bottom of the chord member. However, the bottom chord does include inwardly extending lips 66 and 68, which bearingly engage with the lower surfaces of the thickened portions 50 and 52 and the lower portion of the bolt slots 42 and 44. The top plate 60 of the bottom chord member has an aperture therein for receiving the upright member 10, which is held within the bottom chord member by the bolts 92. The lips 66 and 68 reduce the shear stress that must be carried by the bolts 92. The bottom chord member also includes outwardly extending lips 70 and 72 having the edge thereof flared upwardly. This lip arrangement is used for securing of components to the bottom chord member and increases the stiffness of the bottom chord member.

The top chord member 6, the bottom chord member 8 and the upright members 10, are preferrably extruded of a light weight alloy of aluminum or magnesium although a version of the system made of steel can be used if the increased weight can be accomodated. The extendable legs 24 and 26 can be of many different forms and the form shown for leg 24 includes a support plate 94, having a externally threaded stub tube 100, having a rotatable member 101, thereabout. The leg 24 includes an extension leg rod 95, having a number of holes 102 therein, for receiving the pin member 96. Therefore, the leg is roughly adjusted according to the length required, by proper placement of pin member 96 in one of the holes 102 and member 101 is then adjusted to more accurately position the channel bracket 74 which supports the load collecting beam 22. In this case, the extension leg rod 95, is telescopically received within tube member 34 and the extension rod member 105 of the lower leg is telescopically received within tube member 32. Rod 95 and rod 105 will overlap when the system is arranged in its most compressed or compacted state. A similar type leg arrangement 104, has been shown at the bottom edge of the bottom chord 8, however, these legs are but examples of what can be used and the invention is not limited to these legs. The important point to note, is that the position of the extendable leg rods 95 and 105 intermediate the top chord 6 and the bottom chord 8 can overlap and, therefore, the effective maximum height of the system without considering screw jacks etc securable to the legs is generally significantly greater than twice the spacing between the bottom chord 8 and the top chord 6. The lower leg can be fully received within the truss when the system is "compacted" independent of the amount of upper leg received within the truss.

Figure 3:
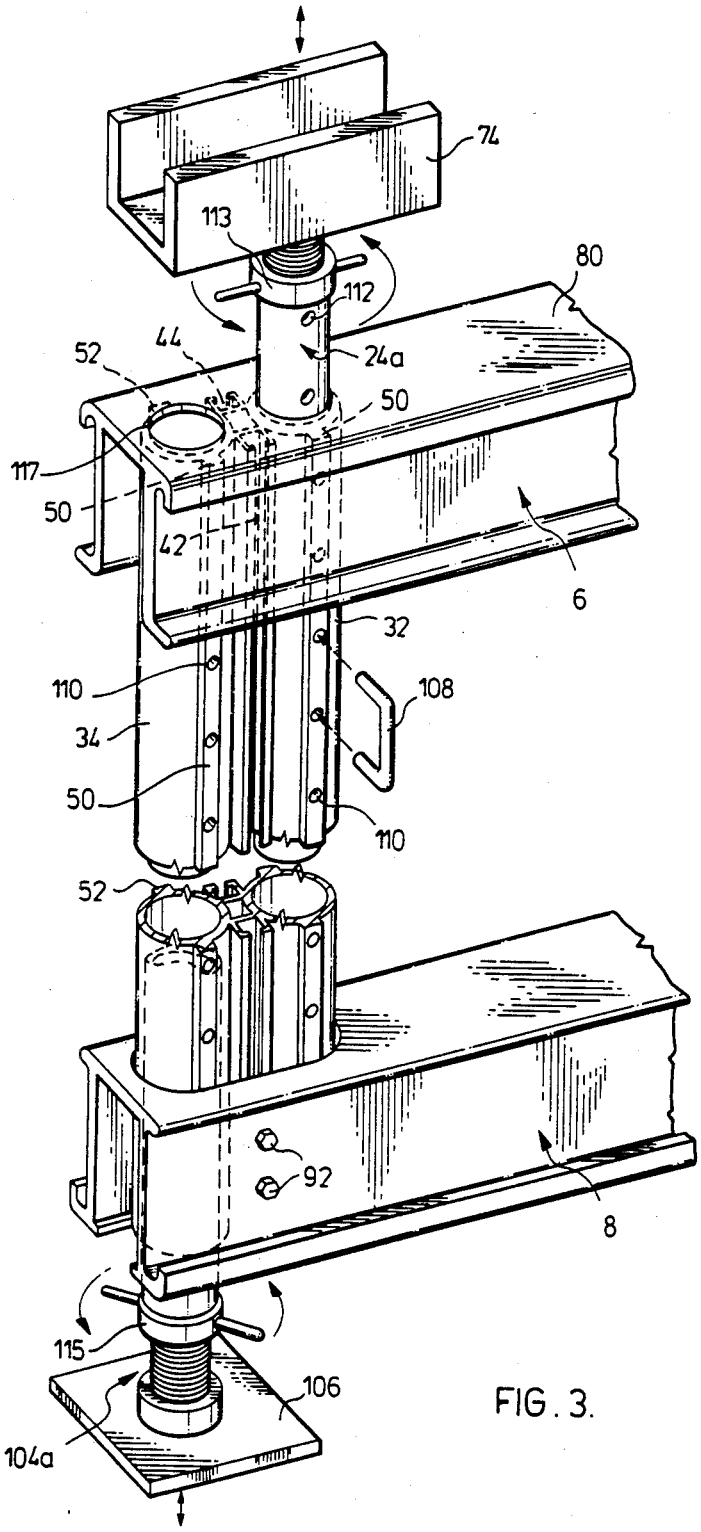
FIG. 3 is a partial perspective view showing additional details of the co-operation between the upright member and the top and bottom chords of the truss.

FIG. 3 shows a similar type arrangement, however, in this case the tube members 32 and 34 of the upright member 10 have a number of holes 110 through the thickened portions 50 and 52 which are alignable with holes 112 of leg 24*a* and 104*a*. A locking U-bar 108 is receivable in adjacent holes 110 of the upright member 10 for passing through holes 112 in the leg 24*a* or 104*a* for providing a rough adjustment of the position of the channel bracket 74 above the top chord member 6 or for spacing of the support plate 106, a certain distance below the bottom chord member 8. More accurate adjustment is achieved by turning of the threaded collars 113 of leg 24*a* or collar 115 of leg 104*a*. In contrast to the structure of FIG. 2 top plate 80 has a somewhat elongate opening 117 to allow leg 24*a* to telescope within the hollow interior of tube member 32. This allows the user to position leg 24*a* to telescope within tube 32 or within tube 34 and appropriately position the bottom leg to telescope within the other tube. Therefore, in the preferred embodiment both tubes 32 and 34 are opened to the upper side of the top chord 6, and are opened to the lower periphery of the bottom chord 8. The elongate opening 117 is not oversized and, therefore, the thickened portions 50 and 52 of each upright member 10 will engage the underside of top plate 80 and similarly the bolt slots 42 and 44 will also engage the top plate. The advantage of two openings rather than one elongate opening 117, is that the portion of the upper chord generally between the tubes remains intact and provides additional bearing surface for upright 10.

Figure 4:
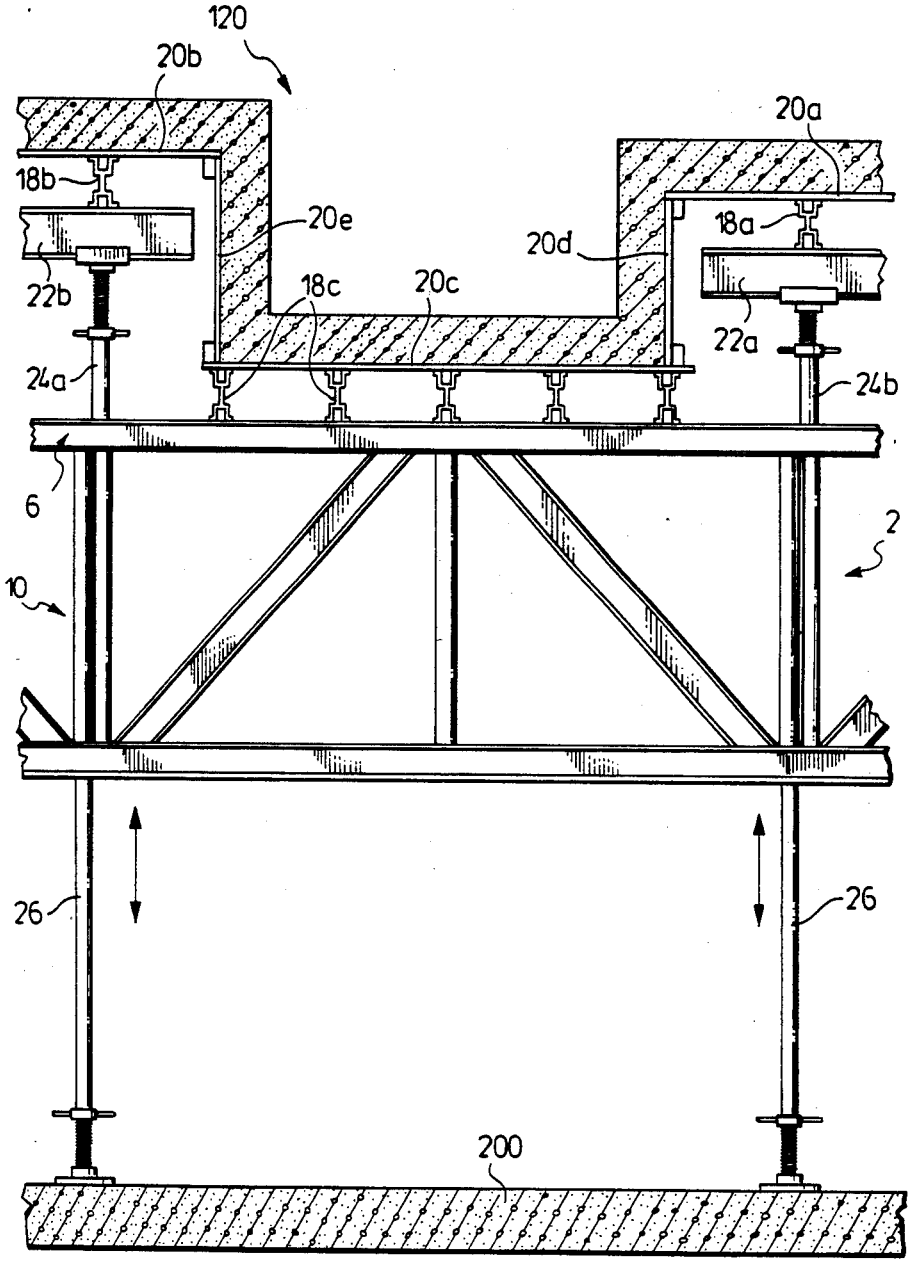
FIG. 4 is a partial front view of the concrete forming system showing a partial section of a vaulted ceiling.
Figure 5:
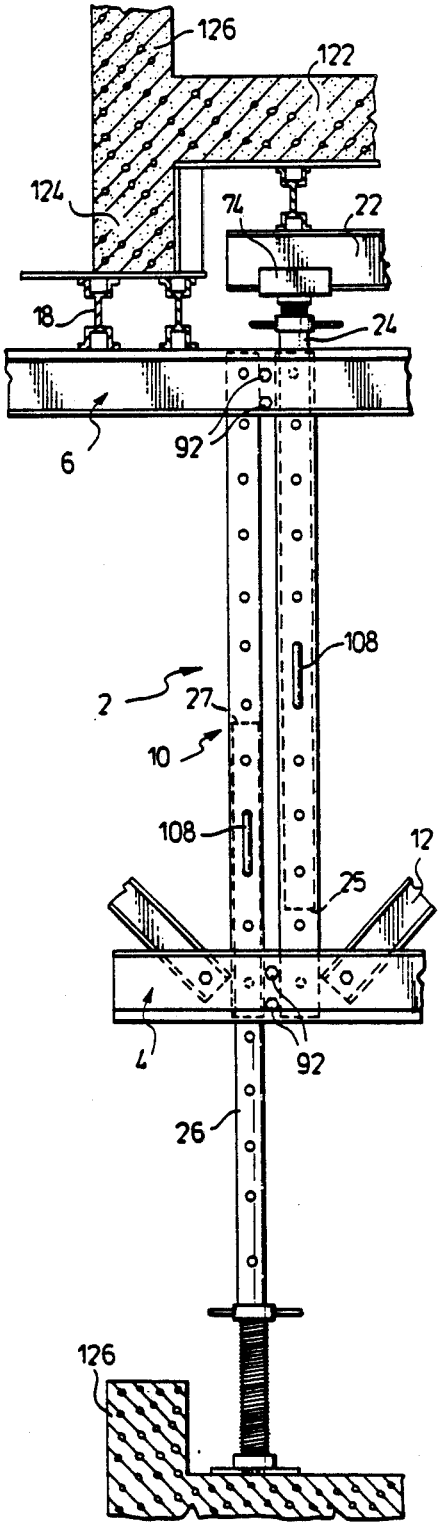
FIG. 5 is a partial front view of a portion of the truss system adapted for forming of a ledge at the edge of the floor.
Figure 6:
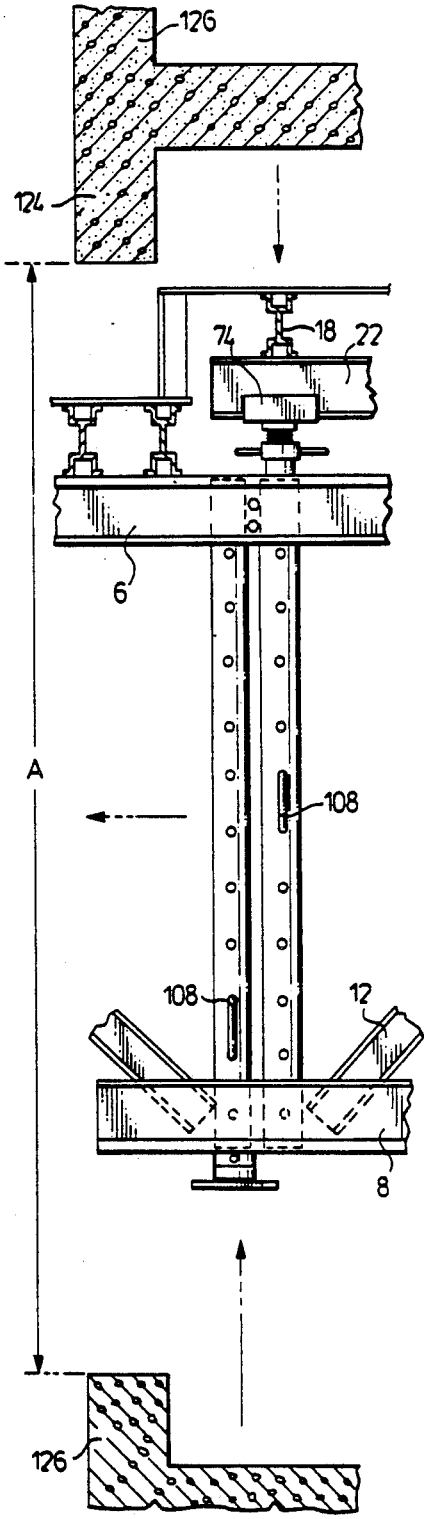
FIG. 6 is view similar to FIG. 5 with the truss in its retracted state for removal from between concrete floors.

FIGS. 4, 5 and 6 illustrate how the concrete forming system of the present application can advantageously be employed. In FIG. 4 a portion of a vaulted ceiling 120 is shown, where load collecting beam **22*b* supports beam 18*b* which in turn supports the sheeting material 20*b* for defining a portion of the form defining the multi-level ceiling. Beams 18*c* can be directly supported on the top chord member 6 of the truss and support sheeting material 20*c* for defining the lower surface of the ceiling. Load collecting beam 22*a* supports beams 18*a* and sheeting material 20*a* for defining another step in the ceiling. In addition, sheeting 20*d* and 20*e* are shown deleting the vertical surfaces of the vaulted ceiling and nailed to the upper and lower level via a number of 2×4's. When it is desired to remove the system 2 from between the lower floor 200, the lower legs 26 are essentially fully telescoped within the upright members 10 and the legs 24*a* and 24*b* preferrably remain at their adjusted position with a certain portion thereof within the upright member 10. Thus the surface 20*b*, 20*c* and 20*a* and any packing will maintain their position relative to the top chord member 6. The system s most effective when the truss is of a height whereby the legs 26 and associated jack screw are close to fully extended whereby the system can pass through a gap slightly larger than the truss and the structure thereabove defining the concrete forming surface. If the height is still too great, packing for surface 20*e* and 20*d* may be removed and legs 24*a* and 24*b*** telescoped within the truss. Normally this is not required but is advantageous in that the ability of the system to move through a narrow space is further increased.

In FIGS. 5 and 6, the system is shown supporting a portion of the concrete floor adjacent the edge of a building. In this case, the floor of the building has a bottom sill 126 projecting upwardly therefrom, and a downwardly projecting portion 124 which extends below the lower surface of the newly poured floor 122. Therefore, the gap between portion 124 and 126 is defined by the spacing "A", and as such the system must compress or collapse to a height less than the spacing "A" to allow the truss to be moved as a unit outwardly through the gap "A" to allow flying of the form to the top surface of the newly poured floor 122.

In FIG. 5, it can be seen that end 27 of leg 26 and end 25 of leg 24, are positioned such that there is an overlap between legs 24 and 26. In this case, the full height capacity of the system was not required. From a consideration of FIG. 6, it can be seen that the end 25 remains at the adjusted position within the upright member 10 and end 27 telescopes to move to be adjacent the top chord 6. Therefore, the ability of the system to compress is independent of legs 24 as each leg 24 and 26 moves independently within the upright member 10. The overall height of the truss can greatly be reduced in its compressed state by telescopic receipt of legs 24 in the truss. This provides a ratio of maximum height of the combined truss and legs independent of jack screws relative to minimum height substantially greater than two and up to about three. This is particularly advantageous in the present design of buildings as it is desirable to have vaulted-type ceilings with downwardly extending ledges where the actual space for moving of the truss exterior of the building has been substantially reduced.

A modified structure is shown in FIGS. 7 through 9, which can be fabricated from commonly available components. The upright 210 has two spaced square tube members 234 and 236 secured and spaced by plates 242 and 244 to define cavity 240 intermediate the tube member 234 and 236 and the top chord 204 defined by opposed channels 205 and 206. Plates 242 and 244 are preferrably welded to tube members 234 and 236. The bottom chord 208 defined by channels 207 and 209, is similiarly attached to the upright 210 secured either side by plates 215 and 217. Bolts 292 pass through the channels and the plates to secure upright 210 to the bottom chord 208 and the top chord 204.

The use of tubes 234 and 236 of square or rectangular section is preferred as welding of plates 242, 244, 215 and 217 thereto is simplified. It is also possible to use tubes of other cross section such as circular and oval although securement to the top and bottom chord is slightly more difficult. The use of welded plates as above will adequately secure the chords to the upright member.

Although various preferred embodiments of the present invention have been described herein in detail, it will be appreciated by those skilled in the art, that variations may be made thereto without departing form the spirit of the invention or the scope of the appended claims.

The embodiment of the invention in which an exclusive property or privilege is claimed are defined as follows:

1. A truss for use in concrete forming comprising a top chord and a bottom chord interconnected by upright members and diagonal bracing members, at least some of said upright members being of a shape for receiving adjustable extension legs each of a length substantially greater than half the distance spacing said top chord and said bottom chord, said upright members receiving adjustable extension legs to extend beyond said bottom chord for supporting said truss and beyond said top chord for supporting a load collecting beam, each leg being independently telescopically movable within said truss.

2. A truss as claimed in claim 1 wherein at various spaced intervals in the length of said truss, said upright members are paired for receiving two extension legs one to extend above said truss and the other to extend below said truss.

3. A truss as claimed in claim 2, wherein said paired upright members are connected by webs and include two tube members for receiving said extension legs, said tube members being separated by an enclosed cavity running the length of said paired upright members.

4. A truss as claimed in claim 3, wherein said webs are opposed and each partially defines bolt slots to either side of and exterior to said cavity running in the length of said upright members.

5. A truss as claimed in claim 3, wherein each tube member includes two planar faces for engaging opposite interior areas of each of said top and bottom chords.

6. The structure of claim 1, wherein the upright members are paired at various spaced intervals along the length of each truss, one of the upright members in each pair receiving an upper adjustable extension leg and the other upright member in each pair receiving a lower adjustable extension leg.

7. A truss for use in concrete forming, comprising:

a top chord and a bottom chord interconnected by upright members and diagonal bracing members, at least some of said upright members being of a shape for receiving adjustable extension legs each of a length substantially greater than half the distance spacing said top chord and said bottom chord, said upright members being paired for receiving two adjustable extension legs, one to extend beyond said bottom chord for supporting said truss and one to extend beyond said top chord for supporting a load collecting beam, each leg being independently telescopically movable within said truss, said paired upright members being connected by webs and each pair including two tube members for receiving said extension legs, said tube members being separated by an enclosed cavity running the length of said paired upright members; said top chord including a channel open towards said bottom chord which channel receives said paired upright members, and said bottom chord including a planar top surface and a channel open on the bottom of said bottom chord, said channel of said bottom chord including lips partially closing the lower edge of said channel of said bottom chord for bearingly supporting an end of each of said paired upright members which upright members extend through an opening in said top surface of said bottom chord and which ends engage said lips on either side of said channel of said bottom chord.

8. A truss for use in concrete forming, comprising:

a top chord and a bottom chord interconnected by upright members and diagonal bracing members, at least some of said upright members being of a shape for receiving adjustable extension legs each of a length substantially greater than half the distance spacing said top chord and said bottom chord, said upright members being paired for receiving two adjustable extension legs, one to extend beyond said bottom chord for supporting said truss and one to extend beyond said top chord for supporting a load collecting beam, each leg being independently telescopically movable within said truss, said paired upright members being connected by webs and each pair including two tube members for receiving said extension legs, said tube members being separated by an enclosed cavity running the length of said paired upright members; wherein each tube member includes two planar faces for engaging opposite interior areas of each of said top and bottom chords, and wherein said webs connecting said upright members are opposed and each partially defines a bolt slot, one to either side of the exterior of said enclosed cavity, said bolt slots oriented along the length of said upright member, each of said bolt slots having an exterior planar face running the length thereof which is co-planar with one of the planar faces on each leg, said planar faces of said bolt slots and said legs engaging an interior area of said top and bottom chord members, said interior areas of said top and bottom chords being brought into pressing engagement with said planar faces by tightening bolts which pass through said top and bottom chord members generally perpendicular to the length thereof and pass through said enclosed cavity of each upright member, each upright member at the ends thereof bearingly engaging said top and bottom chord members to reduce the shear force carried by said bolts when said truss is loaded.

9. A system for use in concrete forming comprising parallel opposed trusses interconnected to maintain the relative positions thereof, each of said trusses including a top chord and a bottom chord interconnected by upright members, each upright member including two parallel elongate members extending between said top and bottom chord with said members secured to the top and bottom of said truss for telescopically receiving extension means extending above and below said truss, said extension means extending below said truss including adjustable legs for supporting said truss above a surface, said extension means extending above said truss supporting at least one load collecting beam which in turn supports joists generally perpendicular to said load collecting beam for supporting a sheet material partially defining a concrete form, said extension means being adjustable to position such sheet material from said trusses various distances by adjusting the extent to which said extension means extend above said truss and allowing the system to collapse by telescopic movement of said legs within the associated truss in preparation for moving of the form to another level, said system when collapsed having at least some overlap of legs extending below said trusses relative to said extension means which extend above said truss.

10. A system for concrete forming comprising at least two trusses interconnected to maintain the relative positions thereof, each truss having a first set of extendable legs telescopically associated with upright members of each truss for positioning of the truss at a height above a support surface up to about the height of the truss and a second set of extendable legs telescopically received within upright members of each truss for supporting means for forming a concrete support surface at various heights above said truss determined by said second set of extendable legs, said first set of extendable legs being associated with said upright members of said truss to permit vertical overlap of said first set of legs and said second set of extendable legs in preparation for moving of said system to a different level.

11. A system as claimed in claim 10, wherein said second set of extendable legs are adapted to support load collecting beams and permit adjustment of said load collecting beams above said trusses, the load collecting beam of one truss being connected to a load collecting beam of the other truss by a plurality of joists which support said support surface, said second set of legs being telescopically received within said trusses to permit said load collecting beams to be generally immediately adjacent said trusses for moving of the system when necessary.

12. A system as claimed in claim 10 wherein said upright members are hollow and receive said legs therewithin, said legs and the hollow of said upright members being of a complementing shape to permit sliding leg movement and limit leg movement laterally within said upright members.

13. A truss for use in concrete forming comprising a top chord and a bottom chord interconnected by upright members and diagonal bracing members; adjustable extension means carried by at least some of said upright members for extending above said top chord to support a load exerted thereon, adjustable extension means carried by at least certain of said upright members for extending below said bottom chord to support said truss above a surface, said extension means and said truss co-operating such that the combined extension of said adjustable extension means provides for supporting a load through said truss at a height substantially greater than twice the height of said truss, and said legs co-operating with said truss to allow selective fully receipt thereof within the height of the truss for moving thereof.

14. A truss as claimed in claim 13, wherein said certain upright members each include two elongate hollow tubes each for receiving an extension means.

15. A truss as claimed in claim 14, wherein each extension means has a cross-section to permit telescopic movement of said extension means within an associated hollow tube with said tube limiting substantial lateral movement of said extension means within said tube.

16. A truss as claimed in claim 15, wherein said hollow tubes of each upright member are interconnected by web means.

17. A truss as claimed in claim 16, wherein said upright members are extruded of an aluminum alloy.

18. An upright member for use in a concrete forming truss comprising means for slidably receiving in the length of said upright member extension legs and, in a manner to limit lateral movement of such extension legs relative to the length of said upright member when received therein, said means for slidably receiving extension legs including two opposed at least recessed portions of a shape for receiving such extension legs and means for connecting said two opposed portions in a parallel relationship said connecting means being of a size and shape for transfering load between said at least recessed portions.

19. An upright member as claimed in claim 18, wherein said connecting means is a web portion generally intermediate said two opposed portions.

20. A structure for use in forming multi-level concrete ceilings comprising at least two trusses interconnected to maintain the relative positions thereof, each truss comprising a top chord and a bottom chord, a plurality of upright members extending between the top and bottom chords, a plurality of lower adjustable extension legs telescopically received in at least some of the upright members extendable beyond the bottom chord for supporting the truss, and a plurality of upper adjustable extension legs telescopically received in at least some of the upright members extendable beyond the top chord; and a plurality of load collecting beams supported above the top chords of the trusses by the upper adjustable extension legs and selectively positioned along the length of the structure to support at least one level of the multi-level ceiling.

21. The structure of claim 20, wherein the load collecting beams are parallel to the top chords of the trusses.

* * * * *